US005445104A

United States Patent [19]

Moody

[11] Patent Number: 5,445,104

[45] Date of Patent: Aug. 29, 1995

[54] APPARATUS FOR THE STORAGE OF CYLINDRICAL OBJECTS

[75] Inventor: Paul E. Moody, Barrington, R.I.

[73] Assignee: The United States of America as represented by the Secretary of the Navy, Washington, D.C.

[21] Appl. No.: 269,322

[22] Filed: Jun. 30, 1994

[51] Int. Cl.[6] ..... B63G 3/02

[52] U.S. Cl. ..... 114/316; 114/238; 211/60.1; 414/281; 414/910

[58] Field of Search ..... 114/316, 238, 239; 89/34, 45; 294/67.3, 81.5; 414/910, 911, 281, 745.1; 244/137.1; 211/60.1, 70.4

[56] References Cited

U.S. PATENT DOCUMENTS

| | | | |
|---|---|---|---|
| 2,789,470 | 4/1957 | Bronson | 89/1.7 |
| 3,552,587 | 1/1971 | Warren | 294/81.5 |
| 4,184,801 | 1/1980 | Nicoloff et al. | 414/608 |
| 4,685,412 | 8/1987 | Harris | 114/238 |
| 4,700,653 | 10/1987 | Harris et al. | 114/316 |
| 4,960,211 | 10/1990 | Bailey | 211/60.1 |
| 5,065,688 | 11/1991 | Moody | 114/238 |

*Primary Examiner*—Sherman Basinger

*Attorney, Agent, or Firm*—Michael J. McGowan; James M. Kasischke; Prithvi C. Lall

[57] ABSTRACT

A support system for submarine weapons. Fore and aft support structures include a plurality of vertically oriented channels spaced to engage rollers on the ends of the saddles that engage and support a weapon on diametrically opposed sides of the weapon. Locking structures position the ends of the saddle in the supporting structure. A crane mechanism can selectively engage the saddles and elevate the weapon into the crane for transport to a loading structure. Upon use of a column of weapons, the saddles can be stored horizontally allowing other operations in the storage space between the support structures.

19 Claims, 8 Drawing Sheets

APPARATUS FOR THE STORAGE OF CYLINDRICAL OBJECTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to the systematic and efficient storage of cylindrical objects, specifically weapons in a submarine.

(2) Description of the Prior Art:

Existing submarine weapon handling systems, especially for torpedoes, comprise either a cradle that supports a weapon over substantially its entire length or a series of dollies that provide spaced supports along the weapon's length. In both systems athwartship track mechanisms and power cylinders move a weapon and its support cradle or dollies horizontally from a storage position to a predetermined transfer point. At the transfer point the support cradle or dollies pivot into alignment with a torpedo tube. Generally the torpedo tube has an axis that is canted with respect to the fore and aft axis of the submarine. A ram transfers the weapon from .its cradle or dollies into the torpedo tube. Once a weapon transfers into a torpedo tube, personnel must store the empty cradle or dollies manually or mechanically before a next weapon can be moved. This activity limits reloading times. U.S. Pat. No. 4,184,801 to Nicoloff et al. for a dual loading and stowage apparatus, U.S. Pat. No. 4,685,412 of Robert M. Harris et al. for a submarine weapon dolly with self stowing bands and my U.S. Pat. No. 5,065,688 for a flexible weapon handling support system are examples of such prior art dollies and cradles.

U.S. Pat. No. 2,789,470 to Bronson for a projectile feed device and U.S. Pat. No. 4,700,653 to Harris et al. for a submarine weapon handling system disclose alternative approaches for handling weapons, including projectiles. The Bronson patent, for example, discloses a rocket-projectile launching system with parallel athwartship tracks above and below the projectile. A chain drive connects to pushers that move the projectiles horizontally from the athwartship tracks to a weapon loading system mechanism. Rotatable claws load and unload a projectile into a firing chamber. The Harris et al. patent discloses a tray for storing a plurality of weapons at discrete locations. Securing bands or tongs at each storage location rotate about and capture the weapon. This essentially provides a single row or level of weapons or projectiles.

When the inventory of weapons to be stowed exceeds the positions in a storage tray, multiple stacked storage trays must be used. Any upper storage level must be self-supporting because it will span any lower storage tray. This requires a robust structure that will withstand potentially significant dynamic or shock loads. The practicalities of such a design limit the storage systems to two storage levels. These systems also generally feed the weapons horizontally to an elevator that subsequently moves the weapon into position for being transferred into a launching tube. As the structures are permanent, the total volume of the system reduces the usable space in the torpedo room with respect to any other special operations that might be possible once weapons have been fired. Moreover, the launching sequence is generally controlled by the position of individual weapons in the storage compartment. If weapons with different characteristics are stowed, it becomes difficult to alter the selection sequence after all the weapons are stored even though particular operations may require such an alteration.

SUMMARY OF THE INVENTION

Therefore it is an object of this invention to provide a storage system for cylindrical objects, including weapons in a submarine, in an efficient and systematic manner.

Another object of this invention is to provide storage apparatus for such cylindrical objects, that improves the flexibility of selecting individual objects.

Still another object of this invention is to provide storage apparatus for such cylindrical objects having different characteristics that facilitates the selection of an object with particular characteristics in an arbitrary sequence.

Yet another object of this invention is to provide a storage apparatus for such cylindrical objects that stores more objects in a given volume than provided by prior art storage apparatus.

Yet still another object of this invention is to provide a storage apparatus for such cylindrical objects for enabling the use of space made available when such objects are removed from storage.

Still yet another object of this invention is to provide storage apparatus for such cylindrical objects that increases the speed with which such objects can be transferred out of the storage apparatus for use.

In accordance with one aspect of this invention, apparatus for storing a plurality of cylindrical objects includes first and second engaging structures that are disposed on opposite sides of each cylinder, each of the engaging structures including a guide at each end thereof. First and second supports mounted normally to a supporting base and transversely to the axes of the stored cylinders and spaced by a distance greater than a predetermined length of the cylinders include a set of first and second spaced complementary guides that receive respective guides from the plurality of sets of the first engaging structures. When the engaging structures are mounted between the first and second supports, they capture the cylinder between them. A releasable locking device interconnects each of the first and second engaging structures and the first and second supports thereby to fix individually the position of each cylindrical object in the apparatus.

In accordance with another aspect of this invention, first and second supports are mounted in a torpedo storage area. These supports extend athwartship and are spaced by a distance greater than the torpedo length. Each contains a plurality of spaced vertical channels. First and second saddles with concave surfaces corresponding to portions of the cylindrical surfaces of the torpedoes abut the torpedo. Rollers at each end of each saddle ,engage the oppositely facing channels in the supports thereby to enable the saddles to capture the torpedo between a pair of saddles. Locking pins interconnect each saddle and each support thereby to positively position each set of saddles within the support.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
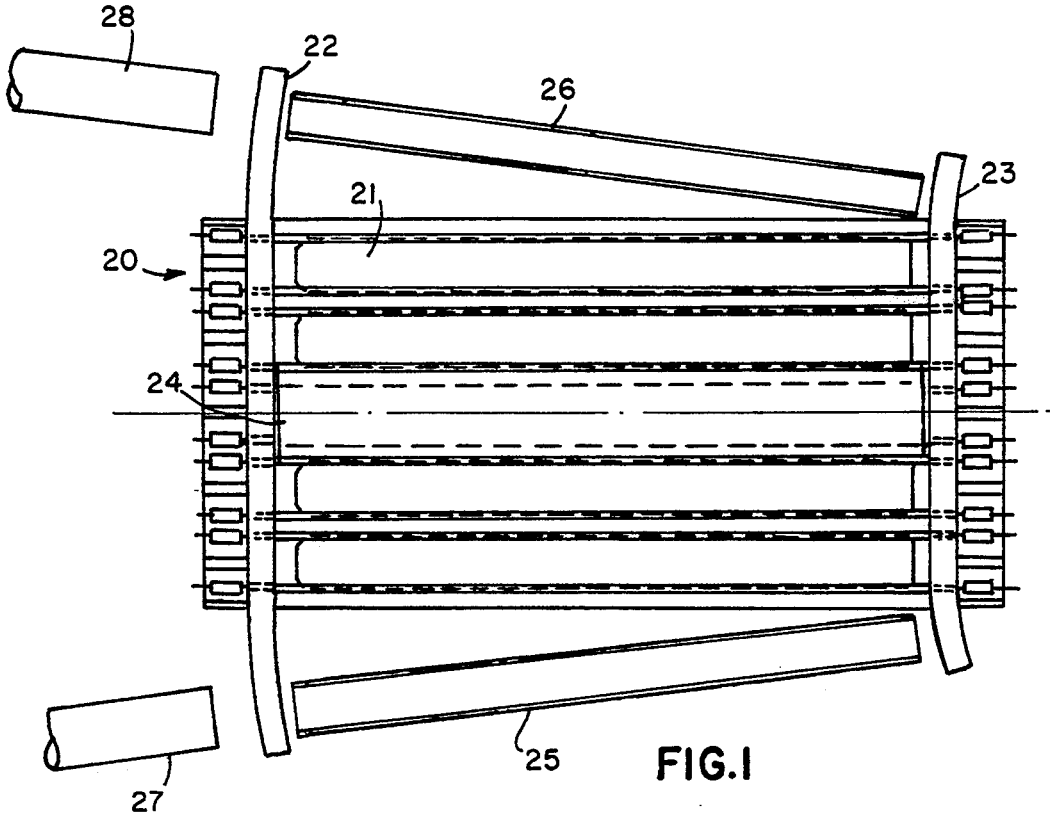
FIG. 1 is a top plan view of a storage system constructed in accordance with this invention.
Figure 2:
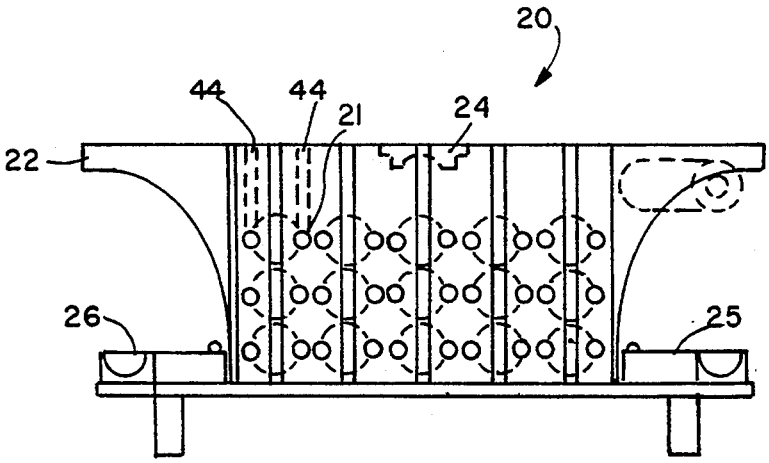
FIG. 2 is an end view of the storage system shown in FIG. 1.

FIGS. 1 and 2 depict a storage apparatus 20 constructed in accordance with this invention for storing a plurality of cylindrical objects, such as torpedoes 21 or other weapons in an area such as a torpedo room. The storage apparatus 20 includes a forward athwartship support 22 and an aft athwartship support 23. The spacing between the supports 22 and 23 exceeds the length of the torpedoes 21. As shown particularly in FIG. 2, the supports 22 and 23 store the plurality of torpedoes 21 at storage positions in a matrix of vertical columns and horizontal rows. In this specific example the apparatus defines fifteen storage positions in five vertical columns and three horizontal rows.

An overhead crane 24 can be suspended between the supports 22 and 23. The crane 24, as described in more detail hereinafter, can retrieve the top torpedo 21 in any column and transport it for transfer to a port hoist 25 or starboard hoist 26. Each of the port and starboard hoists 25 and 26 can elevate to receive the torpedo 21 from the crane 24 and then can lower to align the torpedo 21 with a corresponding port torpedo tube 27 or starboard torpedo tube 28.

As will now be apparent, the apparatus shown in FIGS. 1 and 2 supports all the torpedoes between the forward and aft supports 22 and 23. No robust structure exists between rows of torpedoes 21 so the vertical density of the torpedoes can be increased to provide three rows of torpedoes 21 in essentially the same height as two rows in prior art devices. As the torpedoes 21 in each column are accessible from the top, the selection of torpedoes can be made randomly by column rather than being dictated by the end positions of horizontally stored rows of weapons.

Figure 3:
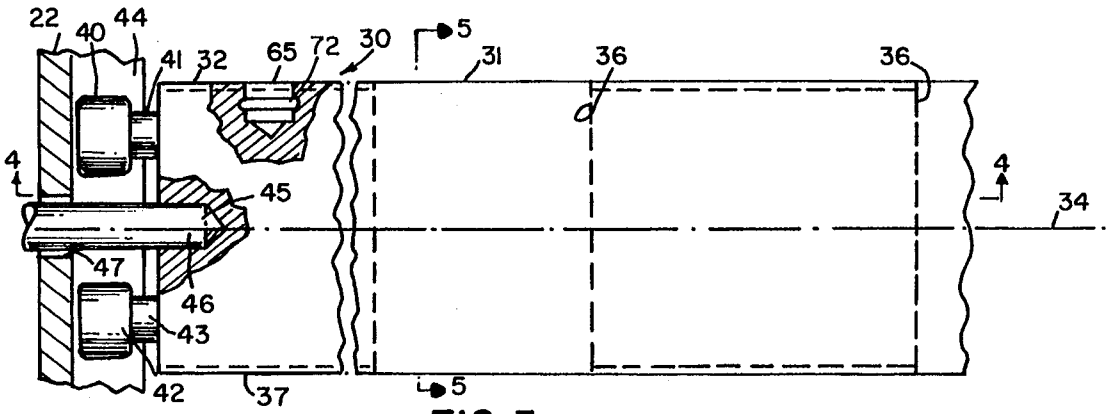
FIG. 3 is an elevation view of a portion of a saddle structure useful in the storage apparatus of FIG. 1.
Figure 4:
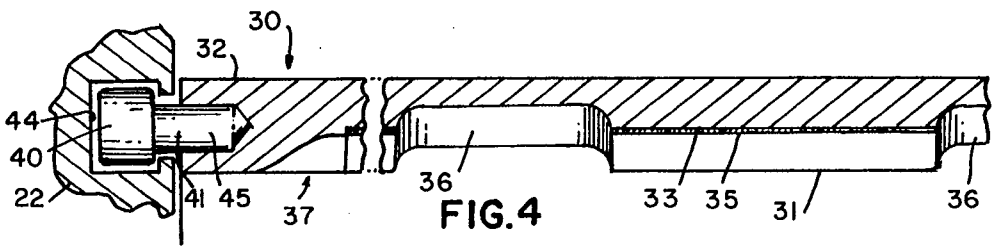
FIG. 4 is a section taken along lines 4—4 in FIG. 3.
Figure 5:
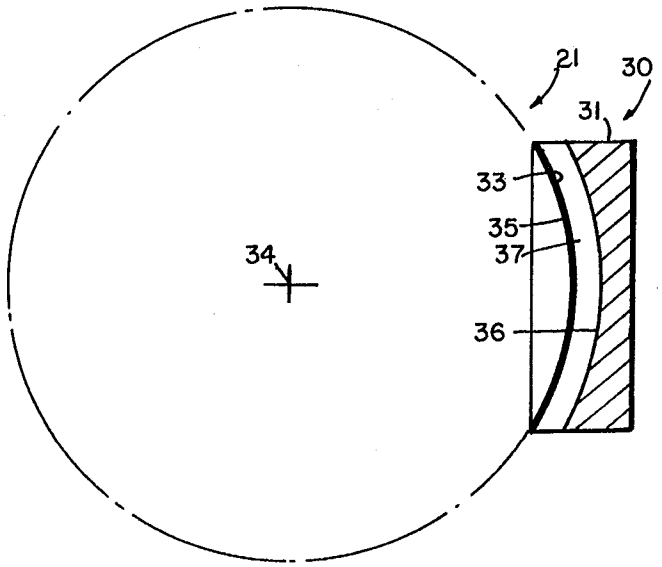
FIG. 5 is a section taken along lines 5—5 in FIG. 3.
Figure 6:
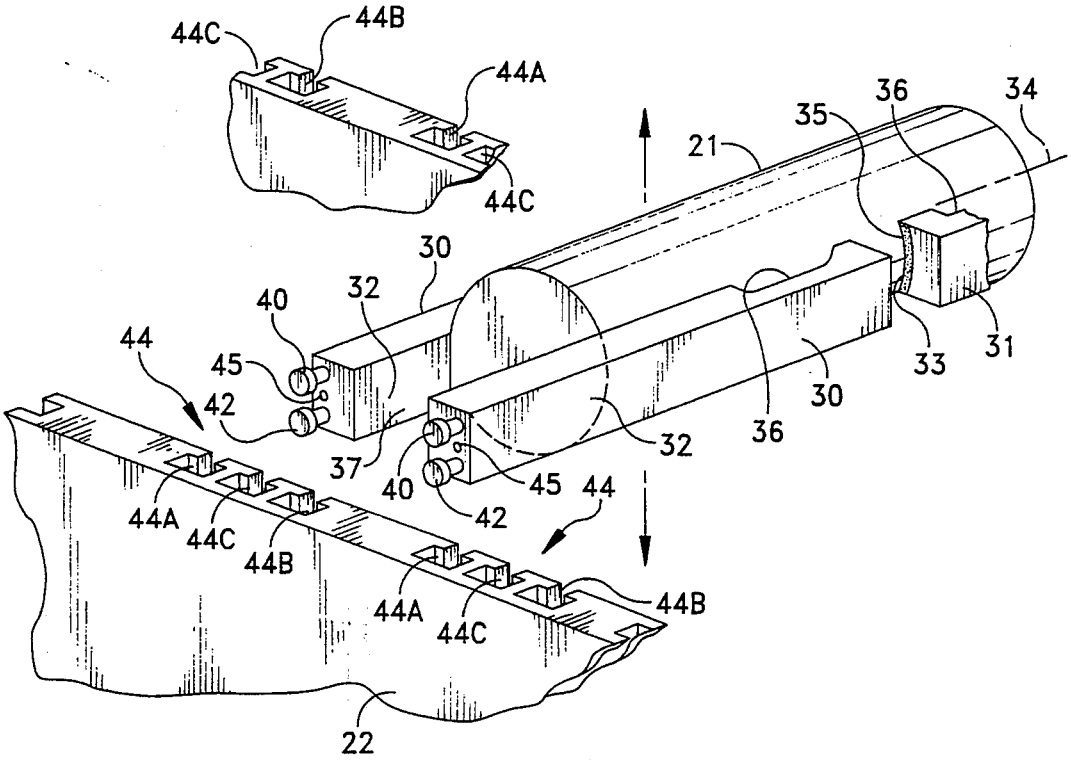
FIG. 6 is a perspective view of a torpedo supported between a pair of saddles constructed as shown in FIGS. 3 through 5.

A pair of identical, counterfacing saddles 30, such as saddle 30 shown in FIGS. 3 through 5 mount between the supports 22 and 23 in FIG. 1 and carry a torpedo 21 therebetween as shown in FIG. 6. Each saddle 30 includes a central portion 31 and identical end portions, one end portion 32 being shown in FIGS. 3 through 5.

The central portion 31 has a concave surface 33 that conforms to the cylindrical surface of the torpedo 21 and supports the torpedo 21 along an .axis 34, as specifically shown in FIG. 5. A nonabrasive elastomeric material 35 can be coated on the concave surface 33 to provide a cushioning layer between the saddle central portion 31 and the torpedo 21. The central section 31 also includes axially spaced relieved sections 36 that receive lifting tongs as described later. A flared portion 37 at each end serves as a transition between the central portion 31 and the end portions, such as the end portion 32, that each have a generally rectangular cross section. The flared portions 37 limit any axial displacement of a torpedo 21 between a supporting pair of saddles 30.

In FIGS. 3 and 4 the end portion 32 carries guides in the form of a first or upper roller 40 on a shaft 41 and a second or lower roller 42 on a shaft 43. The rollers 40 and 42 project from and are spaced at the end portion 32.

The support 22 defines a plurality of sets of spaced vertical channels 44 that act as elongated, complementary, vertical guides for the rollers 40 and 42 when they align vertically. Each set comprises outer spaced vertical channels 44A and 44B that are separated by a distance which will provide sufficient space to locate a central vertical channel 44C, identical in size to channels 44A and 44B. The purpose of this central channel 44C will be described later in this description. Each saddle 30 also includes facilities for locking each end portion 32 to one of the forward or aft athwartship supports 22 and 23 in the form of a locking receptacle 45 between the rollers 40 and 42. A locking pin 46 can then be inserted through one of a plurality of apertures 47 in each of the supports 22 and 23. As shown in FIGS. 3 and 6,, these apertures 47 align with the centers of each outer channel 44A and 44B. They are positioned vertically to align with the center axis 34 of each torpedo in its respective storage position as particularly shown in FIG. 6. Each locking pin 46B extends through an aperture 47 to engage the receptacle 45. Consequently when locking pins 46 are positioned at each end of each of a pair of saddles 30, the saddles 30 carry the torpedo 21 along its axis 34 in a fixed vertical position. The locking pins 46 transfer the load from the saddles 30 to supports 22 and 23.

This is particularly shown in FIG. 6 where a pair of saddles 30 engage a torpedo 21 on opposite sides thereof. As the saddles 30 engage the torpedo 21 along a substantial portion of its length, they collectively provide a structurally robust support for the torpedo under dynamic loading conditions.

Figure 7:
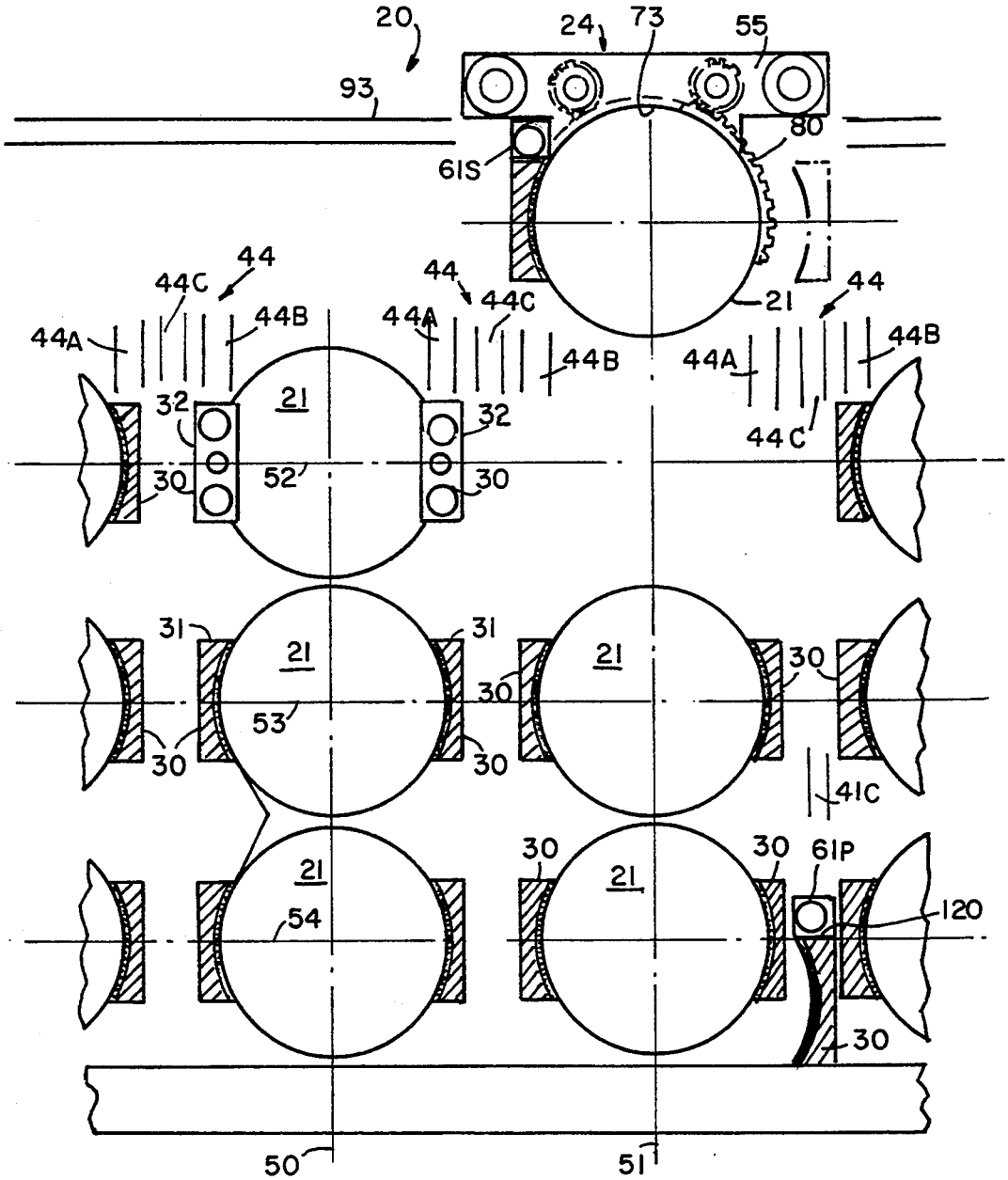
FIG. 7 is an enlarged end view of a portion of the storage apparatus containing a plurality of torpedoes.

FIG. 7 is a view to the aft in a direction generally from the support 22 to the support 23 in FIG. 1 and, for purposes of clarity, depicts only portions of the structure forming certain of the vertical channel sets 44. As will be apparent, however, the vertical channels actually extend for substantially the full height of the storage apparatus 20. A pair of saddles of 30 support each torpedo 21 at a storage position in the storage matrix, the column axes, including column axes 50 and 51, and row axes, including row axes 52, 53 and 54 define. In this particular embodiment the overhead crane 24 aligns with the column axis 51. As previously indicated, the overhead crane 24 can align with any of the column axes and therefore can select the topmost torpedo in any of the columns.

As will now be described with reference to FIGS. 7, 8, and 9, the crane 24 includes a crane bridge 55 with a motorized or other winch 56 on each side of the crane bridge 55. Only one such winch is shown in detail for clarity. Each winch has a forward drum, such as the drum 57, and an aft drum, not shown, and drives the drums in synchronism. Such structures are well known in the art. Each of the drums, such as drum 57, carries a cable 60. The free ends of the cable 60 attach to fore and aft positions on a hoist bar 61.

Figure 8:
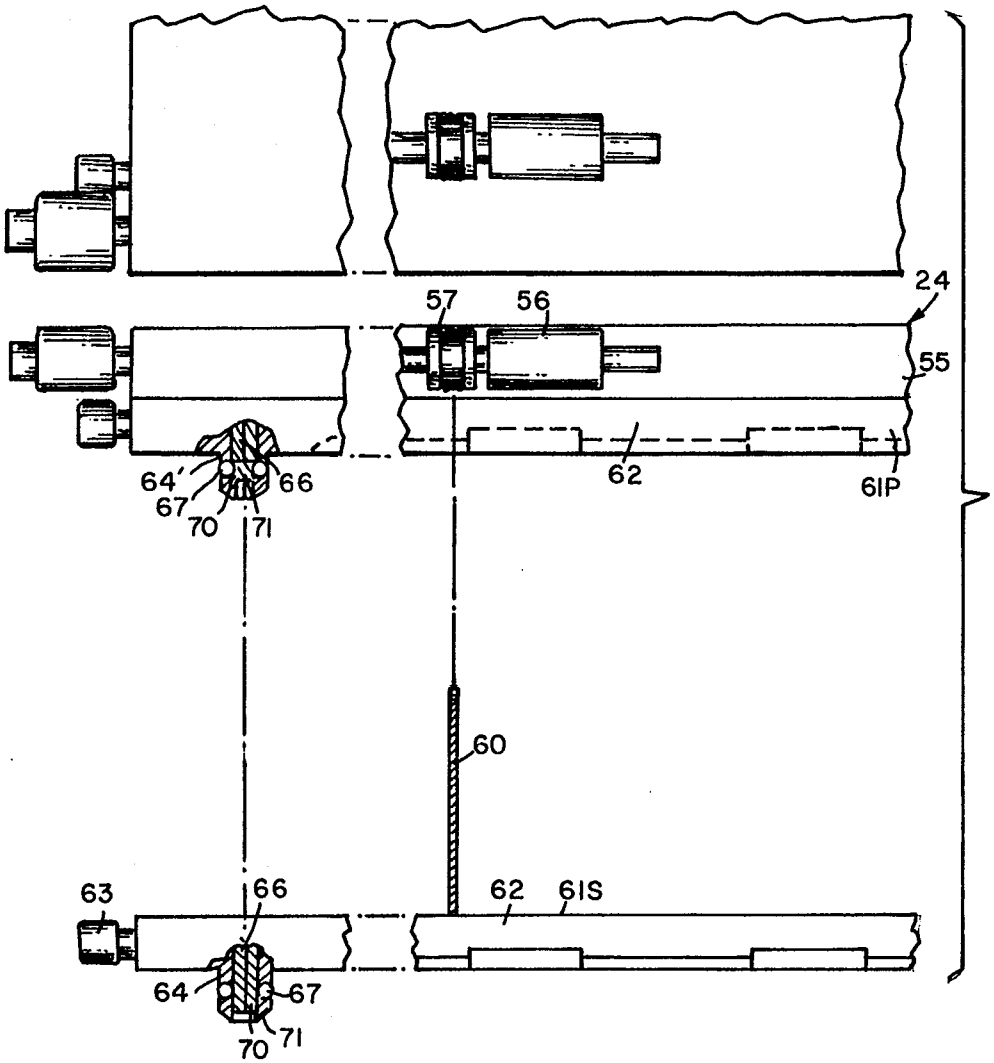
FIG. 8 is an elevation view of a portion of the crane hoist and a hoist bar useful in moving the torpedoes in the storage apparatus of FIG. 1.

FIG. 8 depicts two hoist bars 61 designated as a starboard hoist bar 61S shown in a lowered position, and, a port hoist bar 61P shown in an upper position. Each of the hoist bars 61S and 61P has a central section 62 and a hoist bar roller 63 at either end for riding in one of the vertical channels of a set 44 shown in FIGS. 6 and 7. Each of the hoist bars 61S and 61P has a ball lock assembly 64 located at each end and spaced to align with the sockets 65 shown particularly in FIG. 3. The ball lock assembly 64 that attaches to the hoist bar 61P of FIG. 8 includes a plunger 66 and balls 67 that can move radially in channels 70. When the plunger 66 retracts a tapered end 71 aligns with the channels 70 and allows the balls 67 to displace radially inwardly thereby unlocking the assembly 64 from a saddle.

Referring to FIGS. 3 and 8, after the ball lock assembly 64 is properly positioned, the plunger 66 is extended. As the plunger 66 moves to the extended position, the tapered end 71 cams the balls 67 radially outwardly to lock into a circumferential channel 72 shown in FIG. 3. Thus, the ball locking mechanism 64 shown in FIG. 8 and receptacle 65 shown in FIG. 3 constitute a releasable locking structure. Such releasable locking structures, located at both ends of each hoist bar 61 and saddle 30, enable the hoist bar 61 to engage and lift a saddle 30. Thus to retrieve the topmost torpedo 21 on the column axis 51, the hoist bars 61S and 61P are lowered in the channels 44B and 44A on the starboard and port sides of column axis 51 respectively. After the hoist bars 61S and 61P are locked into position, they raise in synchronism to elevate the torpedo 21 at the intersection of column axis 51 and row axis 53 into a central concave recess 73 in the bottom of the overhead crane 24 shown in FIG. 7.

Figure 9:
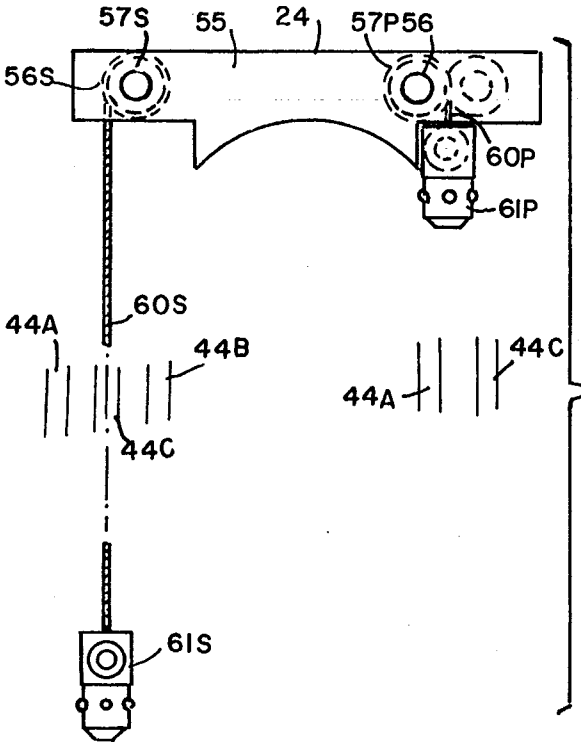
FIG. 9 is an end view useful in understanding the operation of the crane hoist shown in FIG. 8.

Referring to FIGS. 7 and 9, vertical channels 44A and 44B associated with adjacent torpedo storage columns such as channels 44A and 44B in the sets 44 on either side of column axis 51, are spaced sufficiently to allow a saddle 30 to be lowered intermediate the structures forming channels 44A and 44B in the central channel 44C.

To facilitate handling, the winches 56S and 56P can displace laterally to lifting and lowering positions on the crane bridge 55. Specifically, when the winches 56S and 56P are located toward the center of the crane bridge 55, the winches are in a lifting position directly over the inner channels 44A and 44B associated with a particular column of torpedoes. Displacing the winches 56S and 56P laterally outward then aligns the winches 56S and 56P with the spaces between center vertical channels 44C to permit empty saddles to be lowered to a storage position. This occurs without moving the crane 24 that normally will have captured a torpedo prior to the lowering operation.

Figure 10A:
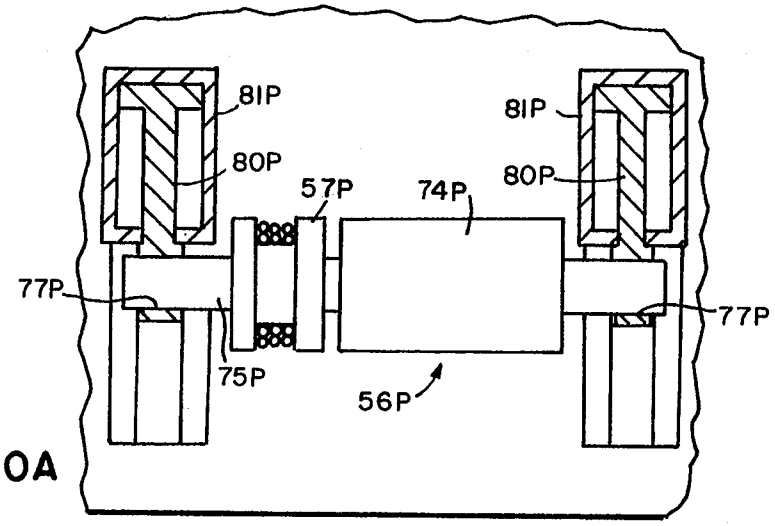
FIGS. 10A and 10B are detailed views of an additional mechanism useful with the crane hoist of FIGS. 8 and 9.
Figure 10B:
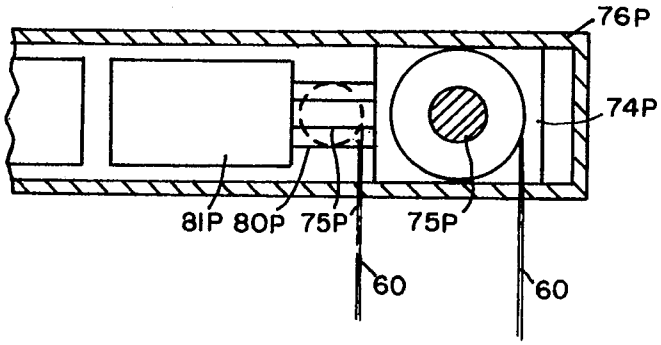

FIGS. 10A and 10B depict a winch 56P associated with the port hoist bar 61P in FIGS. 7 and 9. The winch 56P mounts so the cable 60 hangs vertically from the outboard side of the cable drum 57 during both lifting and lowering operations. More specifically, a winch motor 74P drives a corresponding cable drum 57P on a shaft 75P. A housing 76P allows the winch motor 74P to slide laterally, but prevents the motor housing from rotating. Both ends of the shaft 75P ride in bearings 77P located at the ends of the cylinder shafts 80P extending from power cylinders 81P. In FIG. 10A the power cylinders 81P have retracted the unit 56P to its lifting position. In FIG. 10B, the power cylinders 81P have moved the unit 56P from its lifting position, represented by the shaft 75P′ and cable 60 shown in phantom, to its lowering position.

When the winch 56P is at its lift position, the cable 60P from the outside of the cable drum 57P aligns with the vertical channel 44A for a given storage column. The cable 60S aligns with the vertical channel 44B. After the saddle 30 is detached from the torpedo, cylinders 81P drive the winch 56P to the lowering position so the cable 60P and hoist bar 61P align with the corresponding central channel 44C. A corresponding structure on the starboard side of the crane operates in synchronism so both winches 56S and 56P displace between the lifting and lowering positions simultaneously.

A tong mechanism 80 in the overhead crane 24 moves from a retracted position, shown in FIG. 7 to an extended position in order to grasp a torpedo. Such structures and their operating mechanisms and controls are well known in the art. In such structures a single motor actuates both starboard and port axially spaced tongs through an interconnected gear train. The port and starboard tongs are axially offset to each other thereby to allow complete encompassment of the torpedo. Each tong 80 comprises a curved plate with an inside radius that conforms to the outside radius of the torpedo 21. In a housed position the tong 80 retracts within the crane 24. When a tong actuation motor rotates the drive gears, the tongs extend around the outside of the weapon 21 and have sufficient strength to carry the weapon 21 independently of the saddles 30. As the tongs 31 extend, they also move into the recesses 36 that are axially spaced along the saddles 30 and corresponding recesses in the hoist bar 61. Once the tongs are extended, the winches 56S and 56P can move to their lowering positions to displace the saddles 30 away from the torpedo 21. Once the saddles 30 are stored, the winches 56 raise the hoist bars to the crane 24 so the crane 24 can move the torpedo 21 to the port or starboard hoists 25 and 26 in FIGS. 1 and 2.

Figure 11:
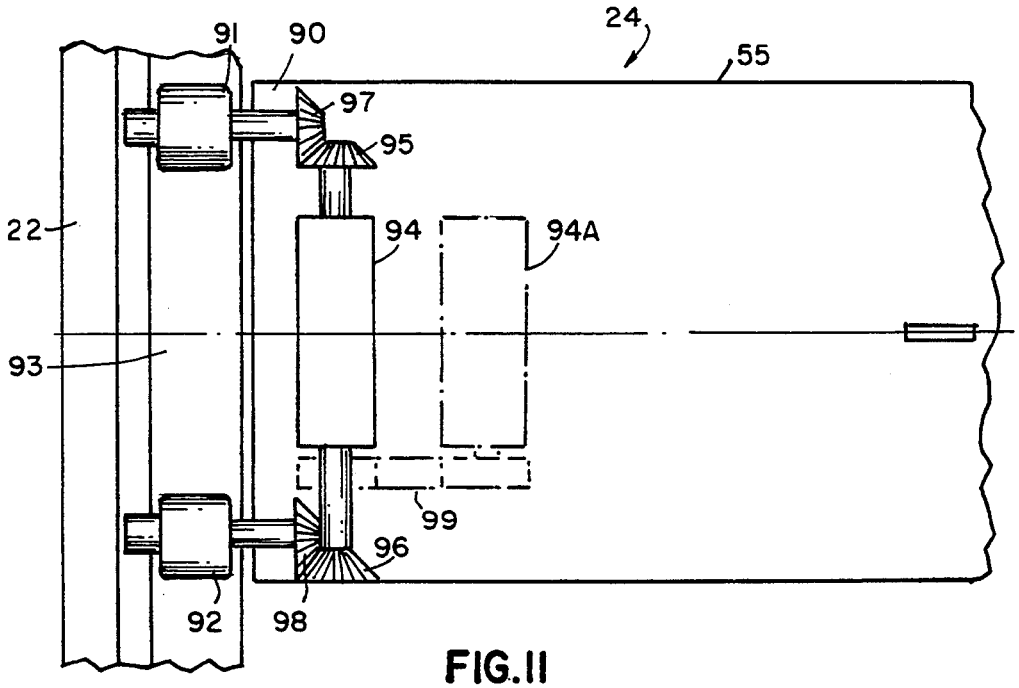
FIG. 11 is a detailed view of another portion of the overhead crane for moving the crane athwartship.

FIG. 11 is a top plan view of the portion of one end of the crane 24 and depicts the structure that moves the crane bridge 55. The bridge 55 lies between the forward support 22 and the rear support 23 (shown in FIG. 1).. At the forward support 22 an end 90 of the bridge 55 carries a pair of drive wheels 91 and 92 that ride on a horizontal track 93. These wheels 91 and 92 and track 93 may have a rack and pinion construction for positive alternative displacement. A single drive motor 94 has front and rear pinions 95 and 96 that engage drive gears 97 and 98 respectively. The drive gears 97 and 98 rotate the wheels 91 and 92 respectively. A second drive motor 94A and gear connection 99, shown in phantom, can be added to minimize the crane height while increasing the drive torque.

Once the overhead crane, as shown in FIG. 7, secures a torpedo into the nested surface 73 with tongs 80 and the saddles 30 have been released at the bottom of the apparatus 20, the hoist bars 61S and 61P are drawn upwardly against the crane 24. Then the drive motor 94 moves the crane structure along the track 93 and the corresponding track attached to the aft support 23 to the port hoist 25 or starboard hoist 26 as shown in FIGS. 1 and 2. As the crane 24 reaches a position at either end of the supports 22 and 23, the tracks 93 curve slightly and pivot the crane into alignment with the respective one of the port hoists 25 or starboard hoists 26.

Figure 12:
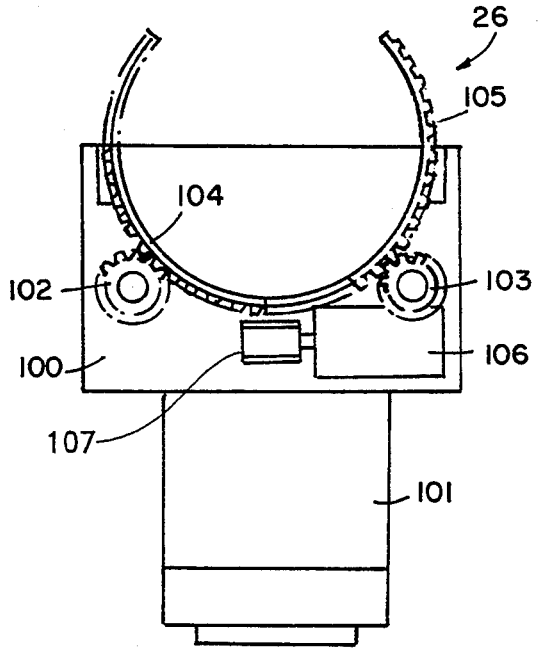
FIGS. 12 is an end view of a typical torpedo room hoist shown in FIG. 1 and useful in connection with this invention.

FIG. 12 is an end view of the starboard hoist 26 that includes a body 100 and a hoist cylinder 101 that elevates the hoist body 100 toward the crane 24. The hoist body 100 carries a tong drive motor (not shown) that rotates tong gears 102 and 103 thereby to extend axially spaced tongs, such as tongs 104 and 105 respectively into an extended position. The tongs on the hoist 26 are axially spaced and interlaced with the tongs 80 on the crane 24. Once tongs 104 and 105 are extended to grip a torpedo, the tongs 80 retract.

Next the hoist cylinder 101 repositions the housing 100 to align the torpedo with the torpedo tube 28. As shown particularly in FIG. 1, the starboard hoist 26 is already aligned longitudinally along the axis of the starboard torpedo 28. Still referring to FIG. 12, a rammer motor 106 and related chain drive 107 or similar structure advance the torpedo 21 into the torpedo tube 28 of FIG. 1. Such positioners and ramming structures are well known in the art.

Referring now to FIG. 7, a loading operation normally begins with the hoist bars 61 in their elevated positions and the tongs 80 retracted. Next the crane 24 moves to a position centered over a storage column axis, such as column axis 51. Mechanisms, like the mechanisms shown in FIGS. 10A and 10B move the winches 56 to their lifting positions and lower the hoist bars 61 to the saddles 30 that support the topmost torpedo 21. After locking the hoist bars 61 to the saddles, the winches 56 tension the cables 60 to enable the release of the locking pins 46, shown in FIG. 3. Then the winches 56 elevate the torpedo 21 and supporting saddles 30 to the bridge 55. Next the tongs 80 extend to transfer torpedo support to the crane 24. The winches 56 then move to the lowering position and lower the empty saddles between storage columns, in center channels 44C. As each saddle 30 has a height of about one-half the diameter of a torpedo, it will be apparent that six saddles from adjacent storage columns, such as defined by storage column axis 51 and the storage column along the axis 50 to the left of the axis 51 in FIG. 7, in the channel 44C between those storage columns. After the hoist bars 61 detach from the stowed, empty saddles 30, the winches raise the hoist bars 61 back to the crane 24.

In this configuration, the crane drive mechanism shown in FIG. 11 can move the crane 24 and its torpedo over the port hoist 25 or starboard hoist 26. The corresponding hoist elevates to engage the torpedo, and the tongs 80 retract after the tongs 104 and 105 extend, thereby transferring the torpedo to the selected one of the hoists 25 or 26. Loading is completed when the hoist 25 or 26 lowers the torpedo into alignment with the corresponding torpedo tube 27 or 28 and the ramming mechanism including the ramming motor 106 and chain drive 107 shown in FIG. 12 transport the torpedo into the tube. During this transfer operation, the crane 24 can move back to a central position in anticipation of a next loading operation.

Figure 13:
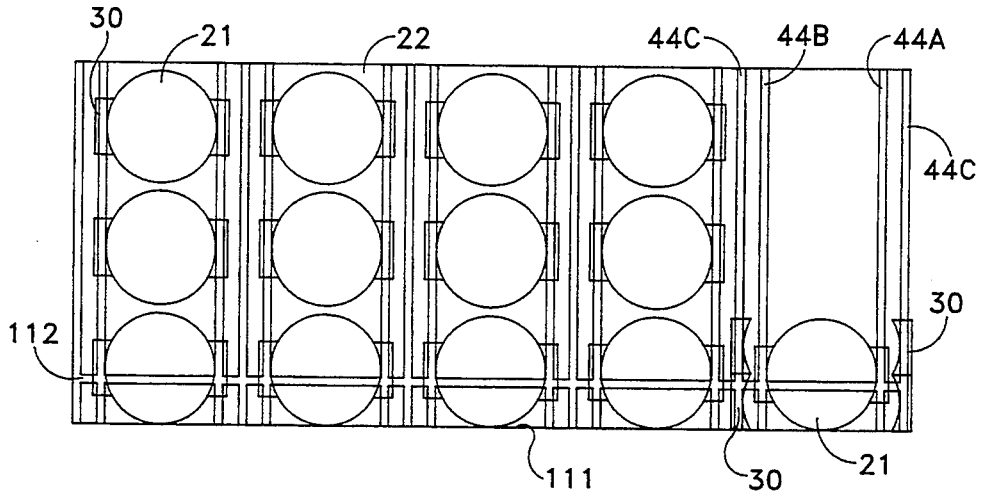
FIG. 13 is a diagrammatic end view of the storage system shown in FIG. 2 after deployment of two torpedoes.
Figure 14:
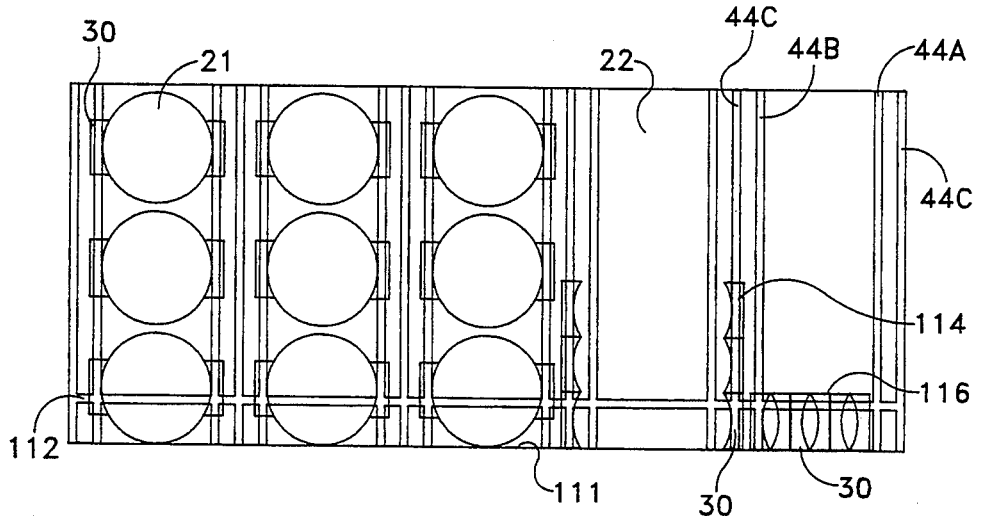
FIG. 14 is a diagrammatic end view of the storage system shown in FIG. 13 showing storage of saddles.
Figure 15:
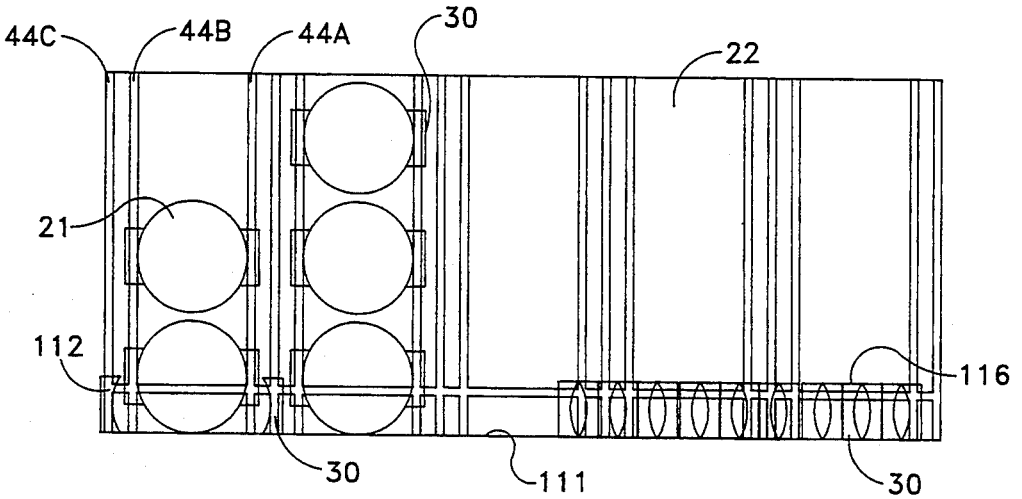
FIG. 15 is a diagrammatic end view of the storage system shown in FIG. 13 showing how saddles form an additional deck surface as they are stored.

Referring now to FIGS. 13–15, there is shown a method for storage of empty saddles 30 after deployment of the associated torpedo 21. After a weapon 21 is transferred to overhead crane 24, saddles 30 are lowered in a vertical storage track 44C located outboard of the saddle's original track 44A or 44B. The rollers 40 and 42 of saddles 30 are confined to track 44C in the same manner as when saddles 30 held torpedo 21. The first saddle 30 for a particular track 44C is lowered until it rests on deck 111 and then it is locked in place by a mechanism similar to locking pins 46. This saddle locking mechanism, however, is mounted on an endless chain (not shown) disposed in vertical track 44C. During operations, a plurality of saddles 30 are loaded in the storage track 44C and locked in place on top of previously stored saddles 30. As weapons 21 are launched, the space in between supports 22 and 23 is emptied, and the saddles 30 are stacked three high in vertical storage tracks 44C outboard of their original storage positions. This storage position is shown at 114 in FIG. 14.

Supports 22 and 23 are equipped with horizontal tracks 112 to allow further movement of saddles 30. Horizontal tracks 112 are positioned to be the same height above deck 111 as the upper roller 40 of saddle 30 resting on the deck 111. A horizontal endless chain (not shown) with locking pins is positioned in the horizontal track 112. Upon complete lowering of the saddle 30, the locking pin on the vertical chain can be disengaged, and the locking pin on the horizontal chain can be engaged. The saddles 30 can be moved by the horizontal chain to a horizontal storage position 116 on deck 111. Each successive saddle 30 can be moved next to a previously stored saddle 30. This allows utilization of space above and to the sides of the stored saddles 30. Referring now to FIG. 15, upon deployment of multiple torpedoes 21 a substantial amount of space can be cleared away by horizontally storing saddles 116. Stored saddles 116 are used as a floor thereby allowing other operations in the torpedo room.

Therefore in accordance with the several objects and advantages of this invention, the disclosed apparatus enables the efficient and systematic storage of cylindrical objects such as torpedoes in a submarine. The space required per weapon over prior art decreases by about 10%. Conversely, the number of weapons can be increased while increasing the overall storage volume available when a full complement of weapons is not on board. Flexibility is achieved by storing weapons in columns and by allowing the apparatus to randomly select the top remaining weapon in each column. Consequently, if weapons with different characteristics are stored in different columns, the apparatus enables weapons to be selected and loaded in a pseudo-random fashion. Weapons handling is greatly facilitated as it is only necessary to disengage locking pins in order to release a weapon from its storage position. All other transfers are controlled by the use of tongs. The motions of the torpedoes relative to the supporting and transfer apparatus are constrained. Furthermore, the crane can change the alignment of a torpedo under transport at the opposite sides of each of the supports thereby to position a loader in permanent alignment with the torpedo tube; the support structure provides the displacement necessary to shift the crane between an alignment with the stored weapons and an alignment with that tube. Finally the system also permits simultaneous operation of a hoist 25 or 26 and corresponding ramming mechanism.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. Apparatus for storing a plurality of cylindrical objects having predetermined lengths on a base along parallel object axes, said apparatus comprising:

a set of first and second engaging means for engaging opposite sides of each cylindrical object, each of said first and second engaging means including a guide at each end thereof;

first and second supports mounted normally to the base and transversely to the cylindrical object axes and spaced by a distance greater than the predetermined lengths, each of said supports including a set of first and second spaced elongated complementary guides for receiving respectively therealong a plurality of sets of said first and second engaging means with a spacing whereby each set of said first and second engaging means captures a cylindrical object therebetween; and releasable locking means for interconnecting each of said first and second engaging means to said first and second supports thereby to fix the position of said set of first and second engaging means and the cylindrical object between said first and second supports.

2. Storage apparatus as recited in claim 1 wherein each of said first and second engaging means contact a portion of the surface of the cylindrical object over a substantial portion of the length thereof.

3. Storage apparatus as recited in claim 1 wherein each of said first and second engaging means has a central portion with a concave surface for abutting a portion of the surface of the cylindrical object over a substantial portion of the length thereof and opposite end portions for supporting the guides.

4. Storage apparatus as recited in claim 3 wherein said concave surface has a shock absorbent coating thereon for contacting the surface of the cylindrical object.

5. Storage apparatus as recited in claim 3 wherein said guide is a roller for providing rolling support for said engaging means and each said complementary guide is a channel in said support for receiving said roller.

6. Storage apparatus as recited in claim 1 further comprising an object displacement means for displacing said first and second engagement means in said complementary guides, said object displacement means including:

first and second displacement link means for being attached to said first and second engaging means; and winch means having a cable connected to said link means for displacing said first and second displacement means essentially simultaneously.

7. Storage apparatus as recited in claim 6 further comprising a winch support on said first and second supports for carrying said winch.

8. Storage apparatus as recited in claim 6 wherein said object displacement means has a concave support means for engaging portions of the cylindrical object free from portions engaged by said first and second engaging means and releasable capture means for clamping the object to said concave support means whereby said concave support means and said releasable capture means can support the cylindrical object independently of said first and second engaging means.

9. Storage apparatus as recited in claim 8 wherein said guide at each end of said engaging means comprises roller means for providing rolling support for said engaging means and each said complementary guide includes a channel in said support for receiving said roller means, said concave support means and releasable capture means being capable of supporting the cylindrical object while said roller means are located in said channels and said object displacement means includes means for enabling said first and second engaging means to be displaced from said respective channels.

10. Storage apparatus as recited in claim 9 additionally comprising means for moving said object displacement means parallel to the base thereby to displace the cylindrical object in a plane normal to the channels.

11. Apparatus for storing a plurality of torpedoes having predetermined lengths on a base along parallel axes, said apparatus comprising:

a set of first and second saddles disposed on opposite sides of each torpedo, each of said first and second saddles including first guide means at each end thereof;

first and second supports mounted normally to the base and transversely to the parallel axes and spaced by a distance greater than the predetermined lengths, each of said supports including second spaced guide means for receiving respectively said first guide means for each of said first and second saddles, the spacing of said second guide means enabling said first and second saddles to capture a torpedo therebetween; and axially displaceable locking pins for interconnecting each end of said first and second saddles to a corresponding one of said first and second supports thereby to fix the position of the torpedo between said first and second supports.

12. Storage apparatus as recited in claim 11 wherein each of said first and second saddles contacts a portion of the torpedo over a substantial portion of the length thereof.

13. Storage apparatus as recited in claim 11 wherein each of said saddles includes a central portion intermediate the ends of said saddle with a concave surface for abutting a portion of the torpedo over a substantial portion of the length thereof, said first guide means at each end of each saddle being received by said second guide means.

14. Storage apparatus as recited in claim 13 wherein said concave surface includes a shock absorbent coating thereon for contacting the torpedo.

15. Storage apparatus as recited in claim 13 wherein each of said first guide means comprises roller means for providing rolling support for its respective saddle and each of said second guide means includes a channel for receiving a said roller means.

16. Storage apparatus as recited in claim 11 additionally comprising crane means for moving a torpedo relative to said storing apparatus, said crane means comprising:

displacement means mounted on said first and second supports for displacing said first and second saddles and a supported torpedo relative to said first and second supports;

first and second displacement link means for being attached to said first and second saddles respectively; and winch means mounted on said ,displacement means for attachment to said displacement link means for displacing said first and second displacement link means and attached saddles essentially simultaneously.

17. Storage apparatus as recited in claim 16 wherein said crane means further comprises:

a concave support surface on said displacement means for engaging the torpedo; and releasable capture means on said displacement means for clamping a torpedo to said concave support surface.

18. Storage apparatus as recited in claim 17 wherein said first guide means comprises roller means for providing rolling support for its respective saddle and each said second guide means includes a channel for receiving said roller means, said concave support surface and releasable capture means being capable of supporting the torpedo while said roller means are located in said channels and said crane means includes means for enabling said first and second saddles to be displaced from said respective channels.

19. Storage apparatus as recited in claim 18 additionally comprising means on said displacement means for moving said crane means parallel to the base.

* * * * *